US008978907B2

(12) United States Patent
Greenberg

(10) Patent No.: US 8,978,907 B2
(45) Date of Patent: Mar. 17, 2015

(54) STRAW HOLDER HAVING A DATE RAPE TESTING CAPABILITY

(75) Inventor: Alex M. Greenberg, New York, NY (US)

(73) Assignee: Greenberg Surgical Technologies, LLC, New York, NY (US)

( * ) Notice: Subject to any disclaimer, the term of this patent is extended or adjusted under 35 U.S.C. 154(b) by 2221 days.

(21) Appl. No.: 11/364,997

(22) Filed: Mar. 1, 2006

(65) Prior Publication Data

US 2006/0144730 A1 Jul. 6, 2006

Related U.S. Application Data

(63) Continuation-in-part of application No. 11/156,748, filed on Jun. 20, 2005, now abandoned, which is a continuation-in-part of application No. 10/888,681, filed on Jul. 9, 2004, which is a continuation-in-part of application No. 10/684,882, filed on Oct. 14, 2003, now Pat. No. 8,505,755.

(51) Int. Cl.

| | |
|---|---|
| ***B65D 47/00*** | (2006.01) |
| ***B65D 55/06*** | (2006.01) |
| ***A47G 19/22*** | (2006.01) |

(52) U.S. Cl.

CPC ..... *B65D 55/06* (2013.01); *A47G 19/2222* (2013.01); *A47G 2400/123* (2013.01); *B65D 2101/00* (2013.01); *B65D 2231/022* (2013.01); *B65D 2517/0098* (2013.01)

USPC ..... 215/229; 215/253; 206/427; 220/708; 220/711

(58) Field of Classification Search

USPC ..... 220/708, 713, 270, 711, 716, 257.2, 220/258.2, 258.3, 266, 254.1; 215/250, 215/253, 230; 116/206; 206/259.1, 427; 436/901, 169

See application file for complete search history.

(56) References Cited

U.S. PATENT DOCUMENTS

| | | | |
|---|---|---|---|
| 947,098 | A | 1/1910 | Ellis |
| 1,156,391 | A | 10/1915 | Conrad |
| 1,462,995 | A | 7/1923 | Wright |

(Continued)

FOREIGN PATENT DOCUMENTS

| | | | |
|---|---|---|---|
| GB | 2382069 | | 5/2003 |
| GB | 2447899 | A * | 10/2008 |

(Continued)

OTHER PUBLICATIONS

Drink Safe Technologies Test Kit Webpage, Http://www.drinksafetech.com/coaster.php, printed Dec. 7, 2005.

(Continued)

*Primary Examiner* — Anthony Stashick
*Assistant Examiner* — Raven Collins
(74) *Attorney, Agent, or Firm* — Cozen O'Connor

(57) ABSTRACT

A drink cover for covering a mouth of a can or a bottle is formed of a flexible sheet material. The drink cover includes a mouth-covering portion dimensioned for placement above the mouth of the one of the can and the bottle so that the entire area of the mouth is covered by the mouth-covering portion and a retaining portion proximate the mouth-covering portion comprising a first edge engageable with the pull tab of the can or the bottle adjacent to the mouth for retaining the drink cover in an installed position on the can or the bottle. The mouth-covering portion is attached to the retaining portion by at least one connection.

13 Claims, 3 Drawing Sheets

(56) References Cited

U.S. PATENT DOCUMENTS

| | | | | | |
|---|---|---|---|---|---|
| 1,735,144 | A | | 11/1929 | Tanner | |
| 1,962,883 | A | | 8/1932 | Tate et al. | |
| 2,070,495 | A | | 4/1935 | Strutz et al. | |
| 2,112,477 | A | | 3/1938 | Brownfield | |
| 2,378,660 | A | | 5/1944 | Roux | |
| 2,878,931 | A | | 3/1959 | Milretta | |
| 3,438,527 | A | | 4/1969 | Gamblin, Jr. | |
| 3,606,156 | A | | 9/1971 | Homorodean, Jr. et al. | |
| 3,777,968 | A | * | 12/1973 | Law | 229/404 |
| 3,822,030 | A | | 7/1974 | Tanzer | |
| 4,049,153 | A | | 9/1977 | Elsasser | |
| 4,247,016 | A | | 1/1981 | Shaw | |
| 4,438,865 | A | * | 3/1984 | Scattaregia | 220/270 |
| 4,502,608 | A | | 3/1985 | Mills | |
| 4,765,090 | A | | 8/1988 | Kuan et al. | |
| 4,872,577 | A | | 10/1989 | Smith | |
| 4,909,437 | A | | 3/1990 | Kang | |
| 4,927,048 | A | * | 5/1990 | Howard | 220/716 |
| 5,160,058 | A | | 11/1992 | Ahn | |
| 5,163,548 | A | * | 11/1992 | Domansky | 206/158 |
| 5,671,863 | A | | 9/1997 | Uliana | |
| D387,396 | S | | 12/1997 | Chao | |
| 5,720,412 | A | | 2/1998 | Ficken | |
| 5,823,493 | A | | 10/1998 | Eastland, Jr. et al. | |
| 5,948,424 | A | | 9/1999 | Kandathil et al. | |
| 5,984,135 | A | * | 11/1999 | Brown | 220/708 |
| 5,992,658 | A | | 11/1999 | Berger | |
| 6,149,111 | A | | 11/2000 | Epstein | |
| 6,299,014 | B1 | | 10/2001 | Nava | |
| 6,703,216 | B2 | | 3/2004 | Parsons et al. | |
| 6,763,681 | B1 | | 7/2004 | Klundt | |
| 7,100,787 | B2 | | 9/2006 | Farnsworth | |
| 2001/0046710 | A1 | * | 11/2001 | Cutler | 436/24 |
| 2003/0044989 | A1 | | 3/2003 | Guerra et al. | |
| 2004/0146429 | A1 | | 7/2004 | Guerra et al. | |
| 2004/0211695 | A1 | * | 10/2004 | Karlsson | 206/427 |
| 2005/0029270 | A1 | | 2/2005 | Marshall | |

FOREIGN PATENT DOCUMENTS

| | | | |
|---|---|---|---|
| JP | 8-72845 | A | 3/1996 |
| JP | 2003-212264 | | 7/2003 |
| WO | WO 99/65782 | | 12/1999 |

OTHER PUBLICATIONS

Drink Safe Technologies Test Kit Webpage, Http://www.drinksafetech.com/testkit.php, printed Dec. 7, 2005.

* cited by examiner

STRAW HOLDER HAVING A DATE RAPE TESTING CAPABILITY

CROSS REFERENCE TO RELATED APPLICATIONS

This application is a Continuation-in-Part of U.S. application Ser. No. 11/156,748, filed Jun. 20, 2005 now abandoned, which is a Continuation-in-Part of U.S. application Ser. No. 10/888,681, filed Jul. 9, 2004, which is a Continuation-in-Part of U.S. application Ser. No. 10/684,882, filed Oct. 14, 2003 now U.S. Pat. No. 8,505,755. The entire contents of U.S. application Ser. Nos. 11/156,748, 10/888,681, and 10/684,882 are incorporated herein by reference.

BACKGROUND OF THE INVENTION

The present invention relates to a drink cover for preventing inadvertent or intentional addition of foreign substances to a drink and drink cover for preventing an inadvertent or intentional introduction of foreign substances to a drink. The present invention also relates to a drink cover incorporating a date rape drug test to determine if a date rape drug is present in a drink.

Date rape drugs are drugs which reduce a victim's inhibitions, render the victim oblivious to his/her surroundings. Such drugs can also render a victim unconscious or cause seizures. The date rape drugs are surreptitiously added to a victim's drink. In the worst case scenario, the victim is robbed or sexually assaulted by a predator who has administered the drug. Efforts to prevent falling prey to a date rape drug include not accepting drinks from people you don't know, not leaving drinks unattended, and not drinking from open beverage sources such as punch bowls. However, constant vigilance of a drink at a party or other social gathering is almost impossible since the owner of the drink will be engaged in conversation, dancing, or other activities.

Tests have been developed to determine if a date rape drug is present in a drink. Examples of such tests are disclosed in U.S. Patent Application Publication Nos. 2004/0146429 and 2003/0044989 and U.S. Pat. No. 6,703,216. These tests have been incorporated in coasters and test strips which can be carried in a wallet, pocket, or purse. However, a more convenient form of the test is required.

SUMMARY OF THE INVENTION

An object of the present invention is to provide a drink cover having a test for detecting date rape drugs present in a drink.

Another object of the present invention is to provide a drink cover that prevents or substantially reduces the likelihood of inadvertent or intentional addition of foreign substances into a drink.

The object of the present invention is met by a drink cover for covering the mouth of a bottle or can. The object is also met by including a test kit on the drink cover having a material which provides a visual indication of the present of a date rape drug when exposed to a liquid containing a sufficient quantity of the date rape drug. The disk cover is formed of a flexible sheet material and has a mouth-covering portion dimensioned for placement above the mouth of one of a can and a bottle. The mouth-covering portion optionally includes an aperture designed to receive a straw therethrough and to vertically support the straw with respect to the support portion. A retaining portion is arranged proximate the mouth-covering portion and has a first edge engageable adjacent the mouth of the can or the bottle for retaining the drink cover in an installed position. The mouth-covering portion is attached to the retaining portion by at least one connection. The drink cover further includes a test section arranged on either the mouth-covering portion or the retaining portion. The test section includes a material thereon which provides a visual indication of the presence of a date rape drug when exposed to a liquid containing a sufficient quantity of the date rape drug.

The test section may be arranged on either the retaining portion or the mouth-covering portion. Furthermore, the test section may be in the form of a test strip detachably arranged on the straw holder using perforations so that a user can rip the test section off of the straw holder.

The drink cover has the additional advantage of being positioned over the opening of the beverage holder, thereby covering and blocking access to the drink. This decreases the probability of having a foreign substance administered into the drink therein because the person attempting to administer the drug is required to move the straw holder out of the way to gain access to the drink.

The drink covers may be provided to purchasers of beverages complimentarily by the establishment supplying drinks, such as a bar, club, or college social club, thereby discouraging the use of date rape drugs and indicating to the public that the use of date rape drugs are not condoned by the establishment.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Methods and kits for testing for date rape drugs are described, for example, in U.S. Patent Application Publication Nos. 2004/0146429 and 2003/0044989 and U.S. Pat. No.

6,703,216, the entire contents of which are incorporated herein by reference. The tests have been packaged as coasters or test strips by DRINK SAFE, Calgary, Canada. However, a more convenient form would be to have the test kits arranged on a form that is carried with the drink. Examples of drink covers and straw holders which cover an opening of and are retained on beverage containers such as cans, bottles, and cups, are described below. Each of the embodiment can incorporate test kits for testing for date rape drugs.

Figure 1:
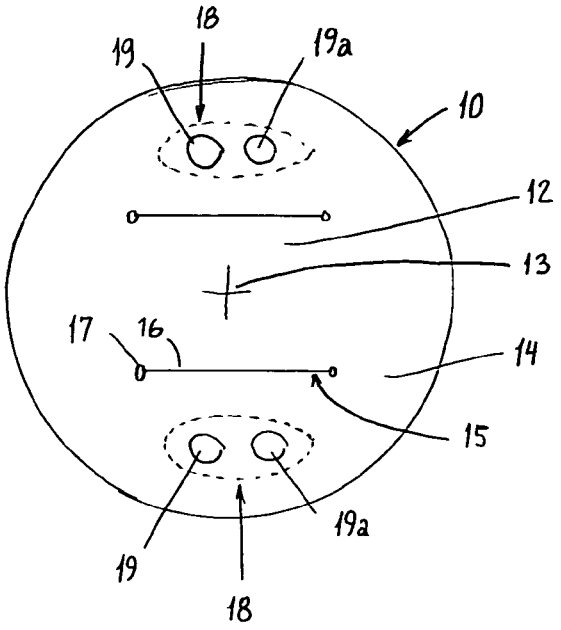
FIG. 1 is a first embodiment of a drink cover according to the present invention.
Figure 1A:
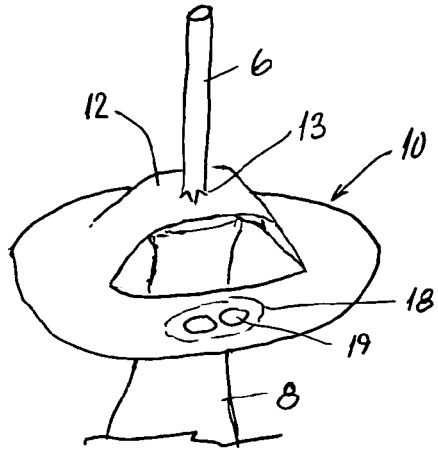
FIG. 1*a* is a perspective view of the drink cover of FIG. 1 arranged on a bottle.

FIG. 1 depicts a straw holder 10 which includes a central mouth-covering portion 12 having an aperture 13 dimensioned to receive a straw in an interference fit, and a bottle retaining portion 14 separated from the mouth-covering portion 12 by a pair of parallel rectilinear slits 15 having respective mutually facing edge portions 16 which are spaced to engage a bottle adjacent to its mouth. In the present example the aperture 13 is formed by a pair of crossed slits which form four bendable tabs as is common in lids on cups. FIG. 1*a* depicts the straw holder 10 on a bottle 8 in the engaged position with a straw 6 received through the aperture 13. The straw holder 10 is further described in U.S. patent application Ser. No. 10/888,681, filed Jul. 9, 2004, the entire contents of which are incorporated herein by reference. Each of the slits 15 terminates at a pair of holes 17 which relieve strain so that a tear will not readily propagate through the portion 14 from the slit 15. An additional pair of slits may be provided parallel to and outside of the slits 15, in order to engage a bottle having a wider mouth.

A test area 18 is arranged on the straw holder including a material 19 that provides a visual indication of the presence of at least one date rape drug such as, for example, Rohypnol or gamma hydroxy butyrate (GHB). The straw holder 10, which acts as a holder for the material 19 in the test area 18, must be sufficiently porous to allow a drink suspected of containing a date rape drug to flow through the straw holder and reach the material 19 in the test area 18. A further material 19*a* may also be arranged in the test area 18 as an indication for a different type of date rape drug such as, for example, ketamine. The material 19, 19*a* may comprise any of the materials disclosed by U.S. Patent Application Publication Nos. 2004/0146429 and 2003/0044989 and U.S. Pat. No. 6,703,216 or any other known or hereafter developed material or technique which provides a visual indication of the presence of a date rape drug upon exposure to a drink containing the date rape drug. Although two materials 19, 19*a* are shown in each test area 18, one, three or more different materials may be arranged in each test area.

To test for date rape drugs, a drop of the drink is placed in the test area 18 so that the fluid being tested flows into all materials 19, 19*a* in the test area. A change in color of materials 19 or 19*a* indicates the presence of a date rape drug. As shown in FIG. 1, the straw holder 10 may include more than one test area 18 so that the test can be performed more than once. Although two test areas 18 are shown in FIG. 1, three or more test areas may alternatively be arranged on the straw holder 10.

Figure 2:
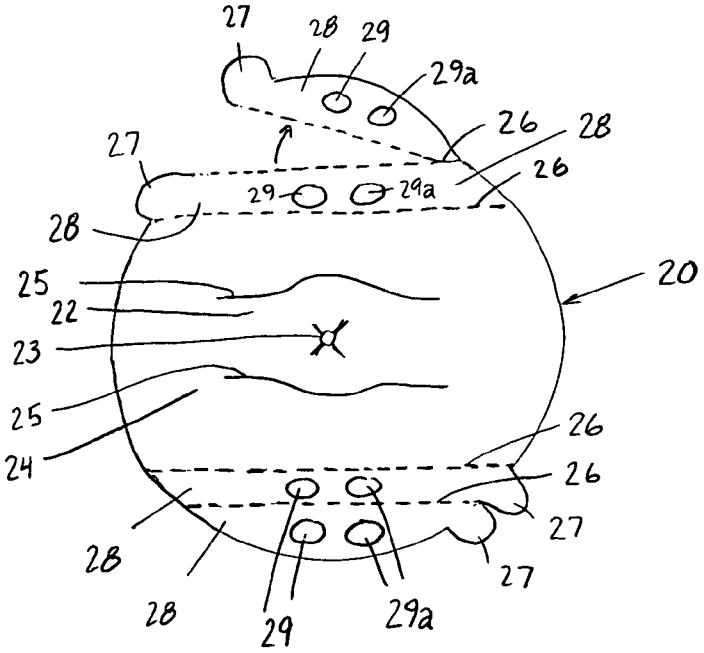
FIG. 2 is a second embodiment of a drink cover according to the present invention.

FIG. 2 depicts a second embodiment of the straw holder 20 which includes a central mouth-covering portion 22 having an aperture 23 dimensioned to receive a straw in an interference fit, and a bottle retaining portion 24 separated from the mouth-covering portion 22 by a pair of slits 25 having respective curved edge portions 26 which face each other concavely and are spaced to engage a bottle adjacent to its mouth. An additional pair of slits arranged parallel to the slits 25 may be provided for engaging a bottle having a wider mouth.

The straw holder 20 of FIG. 2 includes detachable strips 28 which include materials 29, 29*a* that provide a visual indication of the presence of at least one date rape drug. The materials 29, 29*a* are the same as materials 19, 19*a* described above. The strips 28 are connected to the straw holder 20 by perforations 26 so that the strips 28 can be removed from the straw holder 20. The upper strip in FIG. 2 is in the process of being removed. After removal, the strip 28 can be dipped into a drink to be tested. Alternatively, the liquid to be tested can be dropped onto the materials 29, 29*a*.

As is known from U.S. application Ser. No. 11/156,748 filed Jun. 20, 2005, the straw holders 10 and 20 of FIGS. 1 and 2 may be made with only one slit for engaging a tab of a beverage can. A straw holder having one slit may include the strips 28 or the test areas 18 disclosed in FIGS. 1 and 2.

Figure 3:
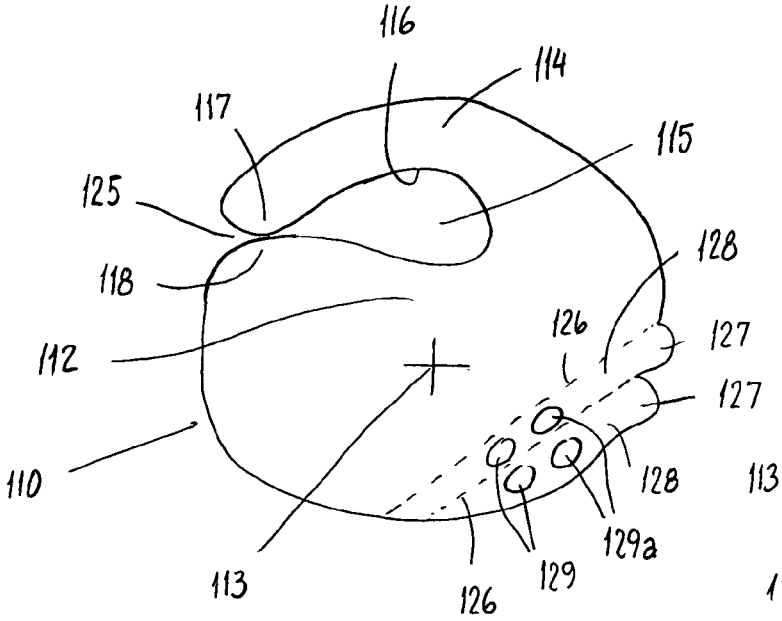
FIG. 3 is another embodiment of a drink cover according to the present invention.
Figure 3A:
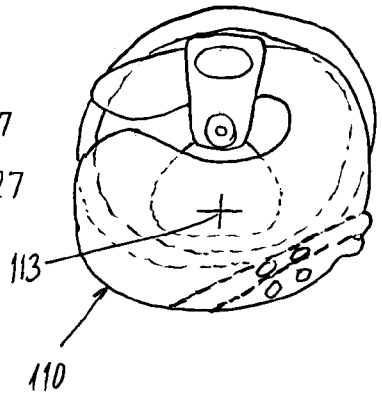
FIG. 3*a* is a perspective view of the drink cover of FIG. 3 arranged on a can.

FIG. 3 shows a straw holder 110 based on another embodiment disclosed in U.S. application Ser. No. 11/156,748, filed Jun. 20, 2005. The straw holder 110 is shown in an engaged position on a beverage can in FIG. 3*a*. Straw holder 110 includes a mouth covering portion 112 having an aperture 113 for receiving a straw, and a retaining portion 114 separated from the straw support portion by a cutout 115. The cutout 115 is open in that a channel 125 extends from the cutout 115 to the side of the straw holder 110 between section 124 of the retaining portion 114 and section 122 of the mouth-covering portion 112. The straw holder 110 may be slid into place such that the connection 121 between the pull tab 3 and the top of the can slides through the channel 125 until the connection 121 is located within the cutout 115. Straw holder 110 includes strips 128 arranged thereon, each including materials 129, 129*a* which are the same as materials 19, 19*a* described above. The straw holder may alternatively or additionally include a test area 18 that is not detachable as described above.

Figure 4:
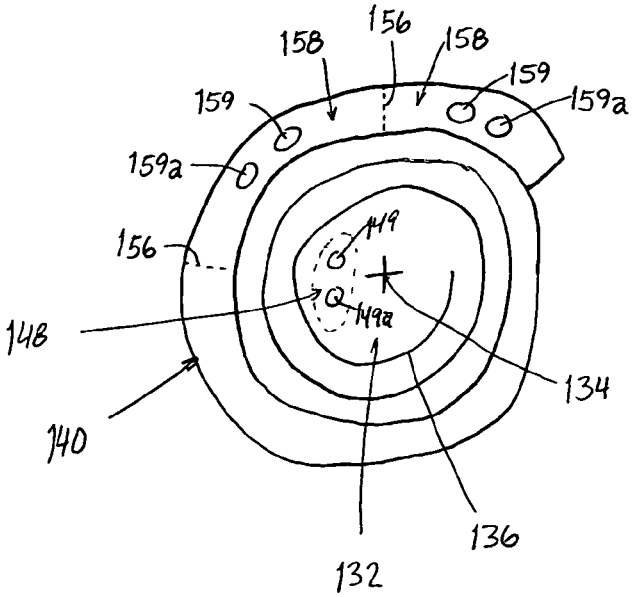
FIG. 4 is yet another embodiment of a drink cover according to the present invention.
Figure 4A:
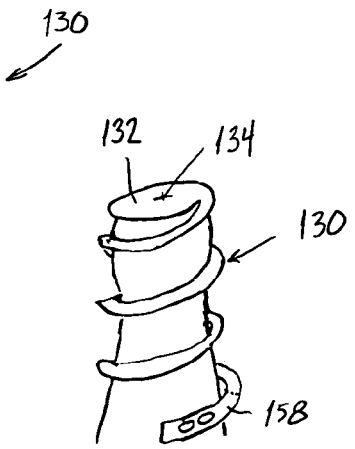
FIG. 4*a* is a perspective view of the drink cover of FIG. 4 arranged on a bottle.

U.S. application Ser. No. 10/684,882, filed Oct. 14, 2003, the entire contents of which are incorporated herein by reference, discloses drinking straw holders for bottles. FIG. 4 is a plan view of another embodiment of the straw holder 130, which includes a mouth-covering portion 132 having a central aperture 134 dimensioned to receive a straw in an interference fit. The mouth-covering portion 132 has an outer edge 136 of continuously increasing radius, forming the profile of a nautilus. A bottle retaining portion 140 connected to the mouth-covering portion 132 comprises a plurality of turns connected to form a spiral. More particularly, the retaining portion 140 comprises a plurality of turns forming a spiral. This configuration results from the cutting of the straw holder from a sheet material with a single slit between turns, which not only economizes use of material, but spaces the turns as closely as possible in order to optimize retention of the holder 140 on a bottle. The turns need not have edges with continuously increasing radii, but may have irregular or undulating edges for decorative effect. FIG. 4*a* depicts the straw holder in a position in which the holder is retained on a bottle. This straw holder design is described in more detail in U.S. application Ser. No. 10/684,882, filed Oct. 14, 2003, which is referred to above.

The mouth-covering portion 132 includes a test area 148 having materials 149, 149*a* for testing a drink for the presence of date rape drugs. The test area 148 and materials 149, 149*a* are similar to the test area 18 and materials 19, 19*a* described above. In addition, the end of the retaining portion 140 includes detachable strips 158, each strip including materials 159, 159*a* for testing a drink for the presence of date rape drugs. The detachable strips maybe connected to the retaining portion by perforations 156. Although both the test area 148 and the test strips 158 are shown in the drawing, the straw support 130 may include only the test strips 158 or only the test area 148.

Figure 5:
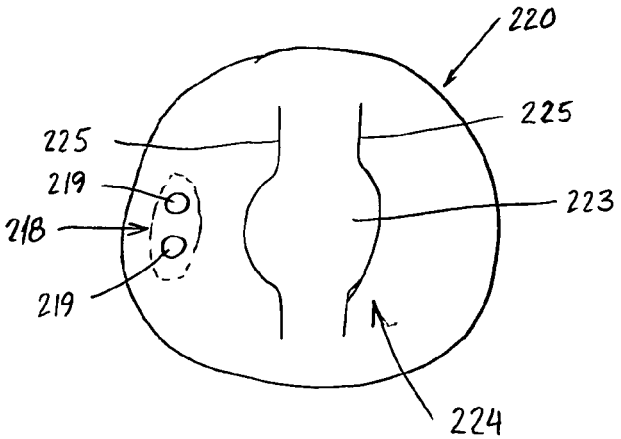
FIG. 5 is another embodiment of a drink cover according to the present invention.
Figure 7:
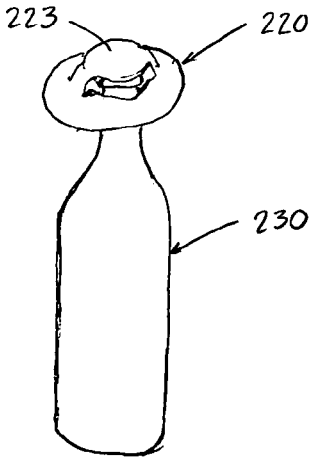
FIG. 7 is a perspective view of the drink cover of FIG. 5 arranged on a bottle.

In each of the above-described embodiments, the mouth-covering portion 12, 22, 12, 132 also provides the further function of covering the mouth of the bottle or can and thereby restricts access to the drink. This prevents or at least make more difficult the inadvertent or intentional introduction of foreign substances into the drink. FIG. 5 shows a drink cover 220 having a mouth covering portion 223 without an aperture for a straw. The drink cover 220 includes a bottle retaining portion 224 separated from the mouth covering portion 223 by a pair of slits 225 similarly to the embodiments of FIGS. 1 and 2 described above. As shown in FIG. 5, a test area 218 is arranged on the straw holder including a material 219 that provides a visual indication of the presence of at least one date rape drug. The test area 218 and materials 219 may be similar to the test are 18 and materials 19 described above. FIG. 7 shows the drink cover 220 arranged on a bottle 230. As depicted, the mouth covering portion 223 designed to cover the mouth of the bottle 230, preventing someone from inconspicuously adding a foreign substance to the contents of the bottle.

Figure 6:
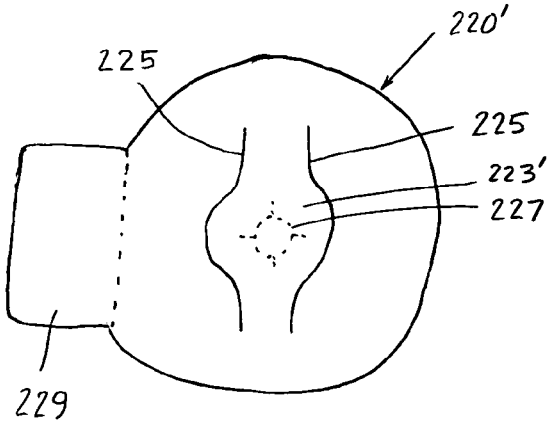
FIG. 6 is an alternative embodiment of the drink cover of FIG. 5.

FIG. 6 shows a drink cover 220' according to a further embodiment which includes perforations 227 defining a hole in a mouth covering portion 223'. The portion of the mouth covering portion 223' within the perforations 227 may be punched out to form a straw receiving hole if use of a straw is desired by a user. The drink cover 220' also includes a tab 229 attached thereto which may include advertising. Alternatively, the tab 229 may be attached by perforations 228 and include a design or photo as a souvenier/momento that is detachable from the drink cover 220'. It is envisioned that the drink covers of FIGS. 5 and 6 will be placed on a bottle or can at the point of sale, i.e., by a bartender or other vendor, when serving the drink to a purchaser.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. For example, the mouth-covering portion 132 in FIG. 4 and the mouth-covering portion 112 in FIG. 3 may each be made without an aperture, as shown in FIG. 5 or with a perforated section as shown in FIG. 6. Furthermore, the drink cover 10 of FIG. 1 and the drink cover 110 of FIG. 3 may include test strips 28 as shown in FIG. 2. It is the intention, therefore, to be limited only as indicated by the scope of the claims appended hereto.

What is claimed is:

1. A drink cover for covering a mouth of a bottle, the bottle and the mouth having a predetermined configuration, the drink cover being formed of a flexible sheet material and comprising:

a mouth-covering portion dimensioned for placement above the mouth of the bottle so that the entire area of the mouth is covered by said mouth-covering portion a retaining portion proximate said mouth-covering portion comprising two edge portions facing said mouth-covering portion and spaced apart for engaging the bottle adjacent to the mouth to retain the drink cover in an installed position on the bottle, the two edge portions formed by two slits in said sheet material, said mouth-covering portion being separated from said retaining portion by said slits, and said mouth-covering portion being attached to said retaining portion by at least one connection, said edge portions each having a central curved portion facing said mouth-covering portion concavely and end portions on opposing sides of said central curved portion, such that said mouth-covering portion has a center section defined by said central curved portions and two end pieces extending from opposing sides of said center section defined by said end portions, a length of said mouth-covering portion through said center section and said end pieces being greater than a diameter of the mouth of the bottle, and said center section being wider than said end sections, said central curved portions of said edge portions configured to engage said mouth of said bottle and retain said drink cover on said bottle; and a test section arranged on one of said mouth-covering portion and said retaining portion, wherein said test section includes a material thereon which provides a visual indication of the presence of a date rape drug when exposed to a liquid containing a sufficient quantity of the date rape drug.

2. The drink cover of claim 1, wherein said test section is arranged on said mouth-covering portion.

3. The drink cover of claim 1, wherein said test section is arranged on said retaining portion.

4. The drink cover of claim 3, wherein said test section comprises a strip detachably connected to said drink cover by perforations.

5. The drink cover of claim 1, wherein said test section comprises a strip detachably connected to said drink cover by perforations.

6. The drink cover of claim 1, wherein one of said two edge portions of said retaining portion comprises a first edge engageable with a pull tab of a can for retaining the drink cover in an installed position on the can.

7. The drink cover of claim 6, wherein said test section is arranged on said mouth-covering portion.

8. The drink cover of claim 7, wherein said test section comprises a strip detachably connected to said mouth-covering portion by perforations.

9. The drink cover of claim 1, further comprising a removable tab attached to said drink cover including one of information or a design, said tab being separable from said drink cover to thereby allow retention of said tab by the user.

10. The drink cover of claim 9, wherein the said tab is connected to said drink cover by perforations.

11. The drink cover of claim 1, wherein said mouth-covering portion comprises an aperture designed to receive a straw therethrough and to vertically support the straw with respect to said mouth-covering portion.

12. A combination including a bottle and a drink cover for covering a mouth of the bottle, wherein the bottle and the mouth have a predetermined configuration, the drink cover being formed of a flexible sheet material and comprising:

a mouth-covering portion dimensioned for placement above the mouth of the bottle so that the entire area of the mouth is covered by said mouth-covering portion; and a retaining portion proximate said mouth-covering portion comprising two edge portions facing said mouth-covering portion and spaced apart for engaging the bottle adjacent to the mouth to retain the drink cover in an installed position on the bottle, the two edge portions formed by two slits in said sheet material, said mouth-covering portion being separated from said retaining portion by said slits, and said mouth-covering portion being attached to said retaining portion by at least one connection, said edge portions each having a central curved portion facing said mouth covering portion concavely and end portions on opposing sides of said central curved portion, such that said mouth covering portion has a center section defined by said central curved portions and two end pieces extending from opposing sides of said center section defined by said end portions, a length of said mouth covering portion through said center section and said end pieces being greater than a diameter of the mouth of the bottle, and said center section being wider than said end sections, said central curved portions of said edge portions configured to engage said mouth of said bottle and retain said drink cover on said bottle and a test section arranged on one of said mouth-covering portion and said retaining portion, wherein said test section includes a material thereon which provides a visual indication of the presence of a date rape drug when exposed to a liquid containing a sufficient quantity of the date rape drug.

13. The combination of claim 12, further comprising a straw, wherein said mouth-covering portion comprises an aperture designed to receive the straw therethrough and to vertically support the straw with respect to said mouth-covering portion.

* * * * *